United States Patent [19]

Frobose

[11] Patent Number: 4,566,735

[45] Date of Patent: Jan. 28, 1986

[54] UPHOLSTERED SEAT FOR CLEAN ROOMS

[75] Inventor: James W. Frobose, Haskins, Ohio

[73] Assignee: The Jasper Corporation, Easton, Md.

[21] Appl. No.: 551,913

[22] Filed: Nov. 15, 1983

[51] Int. Cl.[4] ..... A47C 7/18

[52] U.S. Cl. ..... 297/452; 297/180; 297/DIG. 1

[58] Field of Search ..... 297/DIG. 1, DIG. 2, 297/452, 455, 180; 5/467, 468, 481

[56] References Cited

U.S. PATENT DOCUMENTS

| | | | |
|---|---|---|---|
| 859,828 | 7/1907 | McCloud | 5/468 |
| 1,156,939 | 10/1915 | Smith | 297/DIG. 1 |
| 2,485,918 | 10/1949 | Powell | 297/DIG. 3 |
| 2,713,892 | 7/1955 | Knapp | 297/DIG. 1 |
| 3,082,038 | 3/1963 | Sanderson | 297/DIG. 1 |
| 3,372,407 | 3/1968 | Weber, III | 5/468 |
| 4,445,241 | 5/1984 | Ender et al. | 5/468 |

FOREIGN PATENT DOCUMENTS

| | | | |
|---|---|---|---|
| 1144450 | 2/1963 | Fed. Rep. of Germany | 5/468 |

*Primary Examiner*—William E. Lyddane
*Assistant Examiner*—Mark W. Binder
*Attorney, Agent, or Firm*—Brady, O'Boyle & Gates

[57] ABSTRACT

To assist in maintaining the high degree of cleanliness required by Federal standards in industrial clean rooms, an upholstered seat is provided having a sealed filter unit through which air must flow when entering or exiting the seat structure. The filter unit is held in a sealed grommet installed in a hard base member on which is mounted a cushion. The base member and cushion are enclosed in an air-impermeable cover. The upholstered seat exceeds Federal standards in its ability to avoid contaminating clean rooms.

3 Claims, 4 Drawing Figures

UPHOLSTERED SEAT FOR CLEAN ROOMS

BACKGROUND OF THE INVENTION

The manufacture of microchips and some other industrial products have created a necessity for an extreme degree of cleanliness in manufacturing facilities, commonly called clean rooms. As a result of these cleaniness requirements, Federal standards have been promulgated and must be strictly complied with by the industries involved. Current Federal Standard No. 209B pertaining to classes of room cleanliness establishes three classes of clean rooms, Class 100 being the strictest of these classes. Class 100 specifies that only 100 particles of 0.5 micron size or larger are allowed per cubic foot of air in the clean room. The standard does not pertain to merely an average foot of air but to any cubic foot, at any time. Suggested air velocities are also listed for each class under Federal Standard No. 209B.

A main object of the present invention is to fully comply with and substantially exceed the requirements of Class 100 under Federal Standard No. 209B, in connection with upholstered furniture for clean room use, such as chairs, stools and other seat structures.

Presently, no conventional upholstered furniture or wooden furniture can be tolerated in clean rooms because of the micro particles expelled by them into the environment during normal usage. Such furniture falls far short of even the most liberal class under Federal Standard No. 209B, namely Class 100,000. Metal furniture, such as funiture made entirely of stainless steel, can meet the Federal standards but such furniture becomes so uncomfortable during long usage as to be intolerable, and does not represent a complete solution to the problem.

A further object of the present invention is to provide comfortable upholstered furniture, including various types of seats for clean room usage which fully comply with and exceed the cleanliness requirements under Federal standards or selfimposed industrial standards.

Another object of the invention is to provide seat cushions or seat backs in upholstered forms which include sealed air-impermeable coverings for the yielding cushions and hard base members thereof, in conjunction with a highly efficient filter unit through which all air must flow when leaving or entering the upholstered furniture structure.

The filter unit embodied in the invention employs either a hydrophilic or hydrophobic filtering medium having the ability to exclude particles of only 0.2 microns from passing through the filter unit, thus exceeding substantially the requirements of Class 100 under Federal Standard No. 209B.

Other features and advantages of the invention will become apparent to those skilled in the art during the course of the following detailed description.

DETAILED DESCRIPTION

Figures 1, 2, 3, 4:
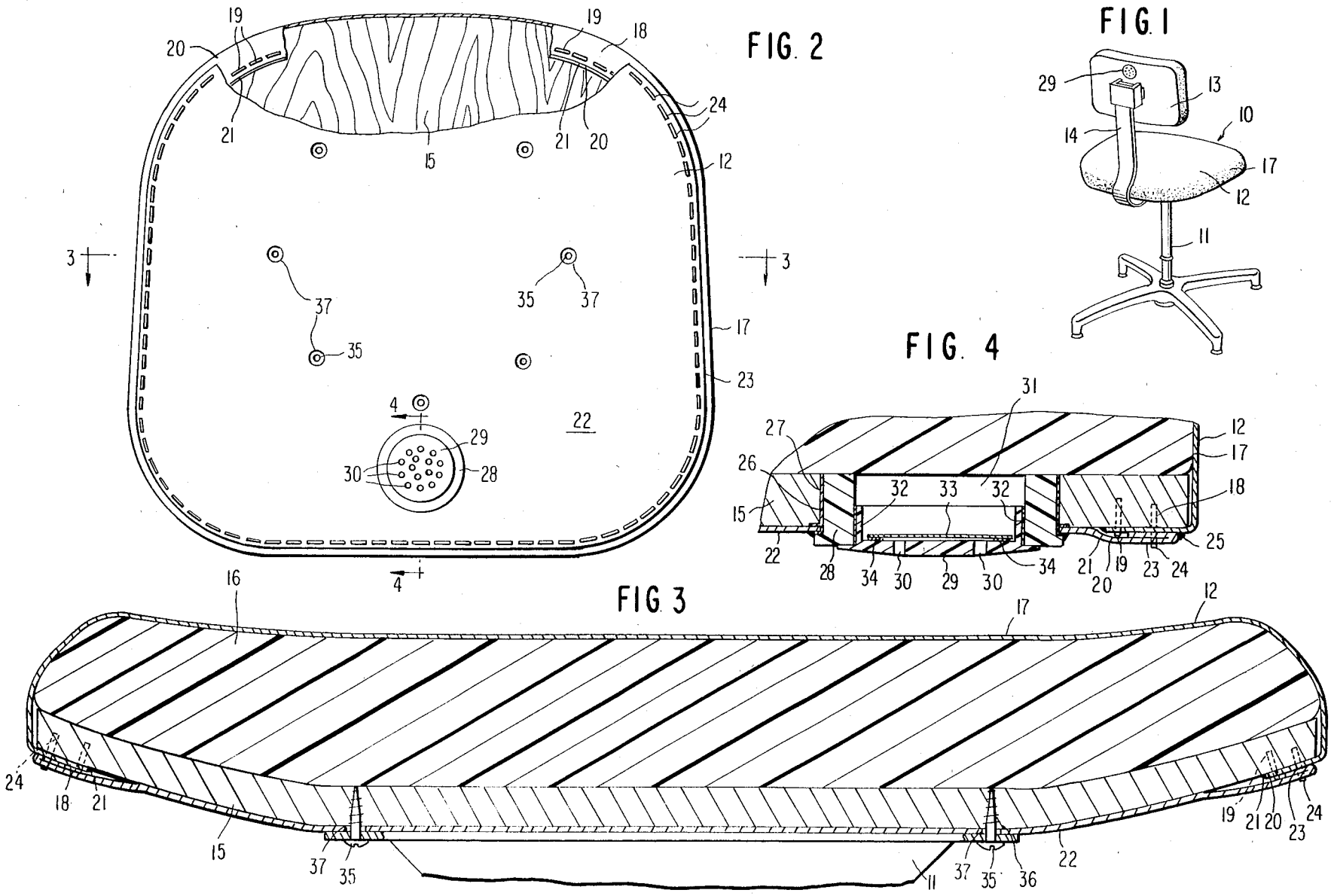
FIG. 1 is a perspective view of an upholstered chair for clean rooms according to the present invention.
FIG. 2 is an enlarged bottom plan view, parts broken away, of the upholstered seat portion of the chair in FIG. 1.
FIG. 3 is a further enlarged vertical section taken on line 3—3 of FIG. 2.
FIG. 4 is an enlarged fragmentary vertical section taken on line 4—4 of FIG. 2.

Referring to the drawings in detail, wherein like numerals designate like parts, a typical upholstered technician's chair 10 for a clean room according to the invention is shown in FIG. 1. The invention is equally applicable to other types of upholstered clean room furniture, such as stools, other types of chairs or benches. The chair 10 in FIG. 1 includes a metal pedestal 11, an upholstered seat 12 attached to the pedestal, and an upholstered backrest 13 adjustably attached to a metal arm 14 rising from the seat 12. The invention herein is embodied in the seat 12 and backrest 13 and can be similarly embodied in any upholstered furniture body supporting surface.

FIGS. 2, 3 and 4 showing the essence of the invention depict in detail the structure of the chair seat 12 in FIG. 1. Substantially the identical details apply to the backrest 13 or to any body supporting portion of other upholstered furniture according to the invention.

The seat 12 comprises a substantially rigid preferably contoured base member 15 of wood or the like on the upper face of which is mounted a resilient cushion 16 of suitable material, such as foam rubber or foam plastics material.

An air-impermeable preferably vinyl top cover section 17 is stretched over the cushion 16 and base member 15 and a lower marginal edge portion 18 thereof is attached permanently to the bottom face of rigid member 15 by a line of staples 19, or equivalent means. The interior edge 20 of top cover section 17 is sealed with a continuous bead 21 of an adhesive air-impermeable sealant.

A bottom cover section or sheet 22 of vinyl is applied over the bottom face of rigid member 15, and a double thickness marginal fold 23 of this bottom cover section is permanently attached to the member 15 by a second line of staples 24 near the margin of the seat 12. If desired, a second continuous sealing bead 25 of adhesive sealing material can be applied between the margin of the double fold 23 and the underlying portion 18 of upper cover section 17. The rolled edge marginal fold 23 prevents air contamination due to frayed edges.

The rigid member 15 near the forward edge and transverse center of the seat 12 is provided with a single opening 26, which is lined with adhesive sealant 27. A rubber grommet 28 or sleeve is then installed snugly in the opening 26 and becomes sealed in place in an air-impermeable manner by the sealant layer 27. The sleeve 28 has a thick cylindrical side wall and a narrow outer end annular flange which is also sealed, as shown in FIG. 4.

A plastics cup-like filter element housing 29 having breathing apertures 30 in its end wall is then pressed into the bore 31 of sleeve 28 with sealant 32 applied, and an air-impermeable seal between the grommet and filter housing is formed. The filter housing 29 has a comparatively thin side wall within the bore 31 of sleeve 28. It can be seen that any air entering the seat 12 or being expelled therefrom must flow through the apertures 30 of filter housing 29. Such air cannotenter or escape around the grommet 28 or around the filter housing 29. Neither can it enter or escape through the impermeable cover sections 17 and 22 or through or around the seal 21.

A filter disc or element 33 is attached near its margin to the interior face of housing 29 with sealant 34. The element 33 spans and covers the apertures 30, and any air entering through or being expelled through these apertures must pass through filter element 33.

This element, which is extremely important in the invention, is preferably a hydrophilic sheet filtering medium manufactured by Gelman Sciences, Inc., Ann Arbor, Mich., under the trademark VERSAPOR, Manufacturer's No. V-200, or their hydrophobic sheet filtering medium, Manufacturer's No. V-200H. Similar material manufactured by others may also be used. The filtering medium can preclude the passage therethrough of particles as small as 0.2 microns in size. The particular material is employed to substantially exceed the requirements under Class 100 of Federal Standard No. 209B.

In the embodiment shown in FIG. 1, the finished seat 12 is attached by screws 35 to flange 36 of chair pedestal 11. The screws penetrate the rigid member 15 and are dipped in adhesive sealant before application. The lower cover section 22, FIG. 2, can be apertured at 37 adjacent to the screws 35.

After long usage of the seat 12 and/or backrest 13, the filter housing 29 can be removed by breaking the adhesive sealant 32 between it and grommet 28. The old filter element 33 can then be removed and replaced with a new filter element which is sealed around its periphery with a continuous line of sealant 34 to the interior face of housing 29. The filter housing 29 is thereafter again pressed into and sealed with sealant 32 into the bore 31 of grommet 28, thus extending the useful life of the clean room furniture according to the invention.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In upholstered furniture for industrial clean rooms, a body support portion comprising a substantially rigid panel member, a yielding cushion on and substantially covering one face of said panel member, an air impermeable sheet material cover for said body support portion surrounding and enclosing said panel member and cushion and being in hermetically sealed relationship to said panel member, said panel member and cover sheet having registering openings formed therethrough, a filtering means within said registering openings and being in hermetically sealed relationship with the panel member and said cover, said filtering means including an apertured filtering element housing, and a filtering element held within said housing in covering relationship to the apertures thereof and being formed as a disc of thin hydrophylic sheet material capable of preventing the passage therethrough of particles substantially as small as 0.2 microns.

2. In upholstered furniture for industrial clean rooms as defined in claim 1, and said filtering means further including a sleeve hermetically sealed in said registering openings of the panel member and cover, said filtering element housing comprising a cup-like housing having a side wall hermetically sealed in the bore of said sleeve and having an end wall which is apertured, said disc lying on said end wall and being adhesively secured thereto around the margin of the disc.

3. In upholstered furniture for industrial clean rooms as defined in claim 1, and said air impermeable sheet material cover including a first cover section spanning said cushion and extending around the marginal edges of the cushion and panel member and overlapping the surface of the panel member away from the cushion, the portion of the first cover section which overlaps said surface of the panel member being hermetically sealed to the panel member, and a second cover section spanning the surface of the panel member away from the cushion and having a folded marginal poriton of double thickness lying on the portion of the first cover section which overlaps said surface of the panel member and being hermetically sealed thereto.

* * * * *